US005830335A

United States Patent [19]

Antille

[11] Patent Number: 5,830,335

[45] Date of Patent: Nov. 3, 1998

[54] BUSBAR ARRANGEMENT FOR ELECTROLYTIC CELLS

[75] Inventor: Jacques Antille, Bramois, Switzerland

[73] Assignee: Alusuisse Technology & Management Ltd., Switzerland

[21] Appl. No.: 773,762

[22] Filed: Dec. 24, 1996

[30] Foreign Application Priority Data

Jan. 26, 1996 [EP] European Pat. Off. ..... 96810051

[51] Int. Cl.[6] ..... C25C 3/00

[52] U.S. Cl. ..... 204/243 M; 204/244; 204/279; 204/297 R

[58] Field of Search ..... 204/297 R, 279, 204/243 M, 244

[56] References Cited

U.S. PATENT DOCUMENTS 4,196,067 4/1980 Friedli ..... 204/243 M
4,397,728 8/1983 Pfister et al. ..... 204/243 M

FOREIGN PATENT DOCUMENTS 0084142 7/1983 European Pat. Off. .
2001344 1/1979 United Kingdom .

*Primary Examiner*—Bruce F. Bell
*Attorney, Agent, or Firm*—Bachman LaPointe, P.C.

[57] ABSTRACT

An arrangement of busbars for conducting direct electric current via busbars from the cathode bar ends of a longitudinally arranged electrolytic cell—in particular for manufacturing aluminum—to the traverse beam ends of the next cell is such that a fraction of the cathode bar ends, on each long side of the cell, is joined to form partial busbars (A, B) which are led from the long side of the next cell perpendicular to their longitudinal direction (x) under the cell and under the cell to a collector busbar (C) which is led under the cell in the longitudinal direction (x) to the downstream end of the traverse beam. As a result of the chosen arrangement of both partial busbars (A, B) and the collector busbar (C) in the form of a "T", optimum compensation is obtained for electromagnetic field forces and, as a result, excellent stability of the electrolytic cell.

8 Claims, 1 Drawing Sheet

BUSBAR ARRANGEMENT FOR ELECTROLYTIC CELLS

BACKGROUND OF THE INVENTION

The invention relates to an arrangement of busbars for conducting direct electric current via busbars from the ends of the cathode bars of a longitudinally arranged electrolytic cell, in particular for manufacturing aluminum, to the ends of the traverse beam of the succeeding cell, whereby one busbar is passed in the longitudinal direction under the cell.

In order to produce aluminum electrolytically from aluminum oxide, the latter is dissolved in a fluoride melt which is for the greater part made up of cryolite. The aluminum precipitated out at the cathode collects under the fluoride melt on the carbon floor of the cell, the surface of the molten aluminum itself forming the cathode. Dipping into the melt from above and attached to anode or traverse beams are anodes which in the conventional process are made of amorphous carbon. As a result of the electrolytic decomposition of the aluminum oxide, oxygen is produced at the carbon anodes and reacts with the carbon of the anodes to form $CO_2$ and CO. The electrolytic process takes place in general at a temperature of approx. 940° to 970° C. In the course of the electrolytic process the concentration of aluminum oxide in the electrolyte falls. At a low concentration of concentration of 1 to 2 wt. % of aluminum oxide in the electrolyte the anode effect occurs whereby the voltage rises from e.g. 4–5 V to 30 V and higher. Then at the latest the crust of solidified electrolyte material must be broken open and the concentration of aluminum oxide raised by adding aluminum oxide.

Under normal operating conditions of the electrolytic cell the crust is broken open at regular intervals and alumina fed to the cell also when no anode effect arises.

Embedded in the cathode floor of the electrolytic cell are the cathode bars, the ends of which extend through both long sides of the so called pot. Theses iron bars collect the electrolyzing current which flows to the carbon anodes of the next cell via busbars situated outside the cell, riser busbars, anode traverse beams and the anode rods. As a result of the high ohmic resistance from the cathode bars to the anodes of the next cell there are energy losses of the order of up to 1 kWh/kg of aluminum produced. Attempts have, therefore, often been made to optimize the arrangement of busbars with regard to this ohmic resistance. Account must be taken, however, of the vertical components of magnetic induction which, together with the horizontal components of current density, generate a field of force in the molten metal produced as a result of the reduction process.

In an aluminum smelter with longitudinally arranged electrolytic cells the passage of current from cell to cell is as follows: The direct electric current leaves the cell via the cathode bars in the carbon bottom of the cell. The ends of the cathode bars are connected via flexible strips to the collector bars or busbars running parallel to the row of electrolytic cells. The current flows from these busbars running along the long sides of the cell via other flexible strips and via riser conductor bars to both ends of the traverse beam of the next cell. Depending on the type of cell the distribution of current between the close and the further removed ends of the traverse beam,—referred to the general direction of flow of current is from 100/0% to 50/50%. The vertical anode rods are bolted to the traverse beam which supports the carbon anodes and feeds them with electric current.

From the magnetic standpoint the state-of-the-art manner of feeding direct electric current is not particularly favorable, as the overlapping of three components of flow generates movements in the liquid metal:

The first type of stirring movement,—in principle a circulatory movement along the inner walls of the cell,—is particularly damaging to the stability of the electrolytic cell. This type of agitation is generated as a result of the influence of the neighboring row of electrolytic cells. The direction of rotation depends on whether the neighboring row of cells lies,—with reference to the general direction of flow of the direct current,—to the left or right of the cell.

The second type of stirring movement arises due to a circular movement in each half of the cell (with respect to its length), the directions of flow being counterwise to each other. This type of rotation depends on the distribution of current between the riser busbars.

The third type of stirring movement is made up of four rotational movements in the cell quadrants; these are such that the directions of rotation in the diagonally facing quadrants are the same. These rotations are a result of unequal distribution of current in the busbars and in the traverse beam from one cell end to the other.

The overlapping of these types of stirring movement causes the metal within the cell to move around at very different speeds. Where all three types of stirring movement run in the same direction, the rate of movement of the metal is high.

Described in the German patent document DE-A-2828180 is an arrangement of busbars of the kind described at the start. This previously known arrangement already provides some compensation for the electromagnetic fields.

BACKGROUND OF THE INVENTION

Taking into account the state-of-the-art technology, it is the object of the present invention to provide an arrangement of busbars of the kind described above by means of which the electromagnetic fields generated by the various manners in which the electrical current flows are compensated for to as great an extent as possible.

That objective is achieved by way of the invention, characterized in that a fraction of the cathode bar ends at each long side of the cell is joined together to form partial busbars which are such that the said partial busbars run from the long side of the next cell transverse to their longitudinal axis under the cell and under the cell to a collector busbar, and the collector busbar under the cell in the longitudinal direction to the downstream end of the traverse beam.

The arrangement of busbars according to the invention for longitudinally arranged electrolytic cells is suitable for arrangements with current strengths of up to 170 KA.

A preferred busbar arrangement is such that the partial busbars are arranged under each cell at their longitudinal center and perpendicular to their longitudinal axis, and the collector busbar runs along the longitudinal axis of the cell.

Usefully, the partial busbars run under each cell between the beams supporting the steel cathode pot, whereby the collector busbar crosses the supporting beams. The arrangement of the partial busbars and the collector busbar is preferably such that they are at about half of the height at which the support beams are situated.

With the configuration of busbars according to the invention both the stationary condition of the cell is improved by reducing the differences in the level of the metal surface and also by the stability of the cell in the non-stationary condition, the latter by reducing the amount of disturbance in the cell during its operation.

BRIEF DESCRIPTION OF THE DRAWINGS

Further advantages, features and details of the invention are revealed in the following description of a preferred exemplified embodiment of the invention and with the aid of the drawing showing in FIG. 1 a cross-section of an electrolytic cell.

DETAILED DESCRIPTION OF PREFERRED EMBODIMENTS

Figure 1:
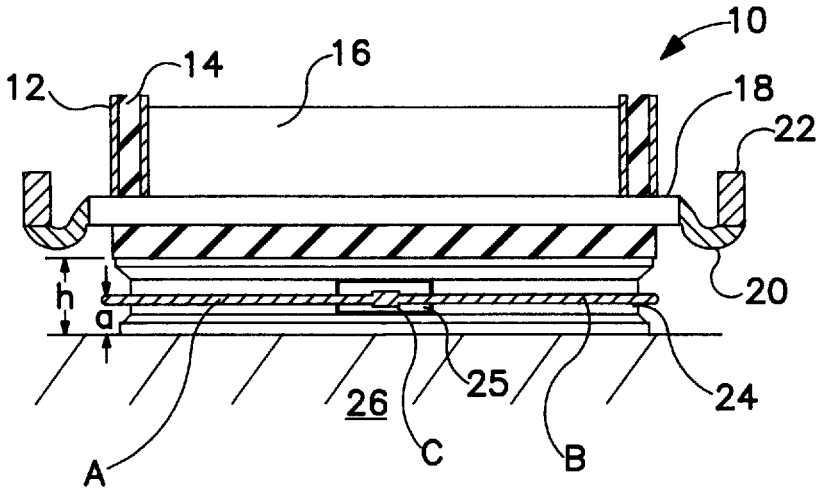

As shown in FIG. 1, an electrolytic cell 10 exhibits a steel pot 12 which is lined with thermal insulation 14 and features a carbon floor 16. Embedded in the carbon floor 16 are cathode bars 18 the ends of which pass through the long sides of the steel pot 12. The cathode bars 18 are connected to busbars 22 via flexible conductor strips 20. The steel pot 12 is situated a distance h from the floor 26 and is supported by steel beams 24.

Figure 2:
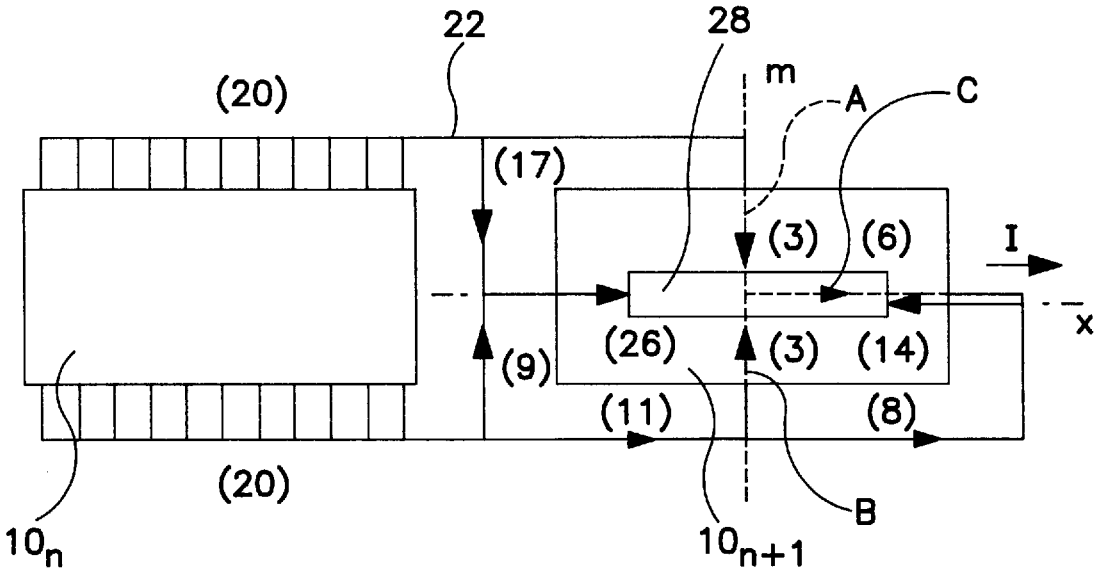
FIG. 2 the principle of magnetic compensation.

The principle of magnetic compensation is seen from FIG. 2 which shows the arrangement for a row of electrolytic cells 10 with a nominal current strength of 140 KA. The general direction of flow of the direct electric current is indicated by I. The numbers shown in brackets in FIG. 2 refer to the number of cathode bars that are joined together to individual collector bars. The distribution of current within the cell depends, for the same type of cell, on the strength of current. As there is no linear relationship between the strength of current and the distribution of current, the latter i.e. the exact number of cathode bar units to be joined to the individual collector bars, is calculated for a particular current density on the basis of magnetohydrodynamic models.

In the present example the electrolytic cell $\mathbf{10}_n$ has 20 cathode bar ends on each long side of the cell, of which 26 cathode bar units feed the upstream lying end of the anode bar or the traverse 28 of the next cell $\mathbf{10}_{n+1}$ and 14 units feed the downstream lying end. 3 cathode bar units on each long side of the cell $\mathbf{10}_n$ are combined to each of a partial busbar A, B and led along the middle m of the next cell $\mathbf{10}_{n+1}$ under the cell to its longitudinal axis x. In the middle of the longitudinal axis x of the cell both partial busbars A, B combine to form a busbar C that is led along the longitudinal axis x to the downstream lying end of the traverse beam 28.

Both partial busbars A, B run between the steel support beams 24. The collector busbar C passes through the steel beam 24 at openings 25 provided for this purpose. The busbar arrangement,—comprising the partial busbars A, B and the collector busbar C,—which is in the form of a "T", is at a height a above the floor 26, corresponding to about half of the height h of the steel support beams 24.

The magnetic effect of the partial busbars A, B and the collector busbar C is reinforced by the closeness of the metal in the electrolytic cell and the ferromagnetic surroundings resulting from the steel pot 12 and the steel beams 24. The small distance of the partial busbars A, B and the collector beam C to the electrolyzed metal in the cell allows the current to be reduced by dividing the busbars into a "T". In the present case, magnetohydrodynamic calculations lead to the results summarized in the following table.

| | | Stationary analysis | | | Stability Analysis |
|---|---|---|---|---|---|
| Busbar arrangement | Current (KA) | Vmax (cm/s) | Vmetal (cm/s) | Δh (mm) | Growth factor $(1/S) \times 10^{-2}$ |
| without "T" | 140 | 28 | 7.8 | 37 | 1.5 |
| with "T" | 140 | 20 | 6.6 | 28 | .44 |

Vmax = maximum rate of flow of liquid metal
Vmetal = average quadratic rate of flow of liquid metal
Δh = difference in level of the surface of liquid metal The values reached show clearly the superiority of the "T"—shaped arrangement of busbars according to the invention compared with a conventional arrangement of busbars. The most important information is provided by the stability analysis. The maximum in the growth factor, which is linked to the states of excitation is in the case of the busbar arrangement in the form of a "T", optimized from the magnetic standpoint, 3 times smaller than that obtained with the arrangement without a "T". As a result of this there is a substantial improvement in the stability of the electrolytic cell.

I claim:

1. Arrangement of busbars, which comprises busbars for conducting direct electric current from the ends of cathode bars of a longitudinally arranged first electrolytic cell having long sides to the ends of a traverse beam of the succeeding longitudinally arranged second electrolytic cell, said second cell having a longitudinal axis and long sides, wherein one busbar is passed in the longitudinal direction under the second cell, wherein a fraction of the cathode bar ends at each long side of the first cell is joined together to form partial busbars which are such that the said partial busbars run from the long side of the second cell transverse to the longitudinal axis of the second cell, and under the second cell to a collector busbar, and the collector busbar runs under the second cell in the longitudinal direction to the downstream end of the traverse beam.

2. Arrangement of busbars according to claim 1, wherein said electrolytic cells are for manufacturing aluminum.

3. Arrangement of busbars according to claim 1, wherein the partial busbars are arranged under said second cell at the longitudinal center thereof and perpendicular to the longitudinal axis of the second cell, and the collector busbar runs along the longitudinal axis of the second cell.

4. Arrangement of busbars according to claim 1, wherein said cells include a steel pot.

5. Arrangement of busbars according to claim 4, wherein said steel pot is supported by supporting beams.

6. Arrangement of busbars according to claim 5, wherein the partial busbars run under each cell between the supporting beams of the steel pot, and the collector busbar crosses the supporting beams.

7. Arrangement of busbars according to claim 6, wherein the partial busbars and the collector busbars run under each cell at a height which is about half the height of the supporting beams.

8. Arrangement of busbars according to claim 1, wherein a second fraction of the cathode bar ends at each long side of the first cell run to the upstream end of the traverse beam of the second cell.

* * * * *